US010914523B2

(12) United States Patent
Cho et al.

(10) Patent No.: US 10,914,523 B2
(45) Date of Patent: Feb. 9, 2021

(54) PLASMA FURNACE HAVING LATERAL DISCHARGE GATES

(71) Applicant: KOREA HYDRO & NUCLEAR POWER CO., LTD., Gyeongsangbuk-do (KR)

(72) Inventors: Hyun-Je Cho, Daejeon (KR); Cheon-Woo Kim, Daejeon (KR); Sang-Woo Lee, Daejeon (KR); Sang-Woon Shin, Chungcheongnam-do (KR)

(73) Assignee: KOREA HYDRO & NUCLEAR POWER CO., LTD., Gyeongsangbuk-do (KR)

( * ) Notice: Subject to any disclaimer, the term of this patent is extended or adjusted under 35 U.S.C. 154(b) by 356 days.

(21) Appl. No.: 15/750,278

(22) PCT Filed: Aug. 18, 2015

(86) PCT No.: PCT/KR2015/008580

§ 371 (c)(1),
(2) Date: May 11, 2018

(87) PCT Pub. No.: WO2017/026562

PCT Pub. Date: Feb. 16, 2017

(65) Prior Publication Data

US 2018/0363982 A1 Dec. 20, 2018

(30) Foreign Application Priority Data

Aug. 12, 2015 (KR) ..... 10-2015-0114045

(51) Int. Cl.
*F27B 3/10* (2006.01)
*F27D 3/00* (2006.01)
(Continued)

(52) U.S. Cl.
CPC ..... *F27D 3/14* (2013.01); *F23G 5/085* (2013.01); *F27B 3/105* (2013.01); *F27B 3/19* (2013.01);
(Continued)

(58) Field of Classification Search
CPC ..... F27D 2099/0031; F27B 3/28; C22B 9/10; C22B 7/04
See application file for complete search history.

(56) References Cited

U.S. PATENT DOCUMENTS 3,744,438 A * 7/1973 Southwick ..... F23G 5/085 110/243
4,521,890 A * 6/1985 Burnham ..... F27B 3/08 373/22
(Continued)

FOREIGN PATENT DOCUMENTS

DE 4024700 A1 2/1992
JP H0480514 A 3/1992
(Continued)

*Primary Examiner* — Dana Ross
*Assistant Examiner* — Lawrence H Samuels
(74) *Attorney, Agent, or Firm* — Standley Law Group LLP; Stephen L. Grant

(57) ABSTRACT

The present invention relates to a plasma furnace capable of separating and discharging different kinds of molten material, which comprises a furnace body 110; and a heating portion 140 for heating the lateral discharge gate 120, 130, wherein the furnace body comprises a melt discharge portion formed through a lower portion of the melting chamber 101 provided for accommodating molten material; and at least two lateral discharge gates 120, 130 provided at different heights capable of discharging molten material.

6 Claims, 5 Drawing Sheets

(51) Int. Cl.

| | |
|---|---|
| ***F23G 5/08*** | (2006.01) |
| ***F27D 3/14*** | (2006.01) |
| ***F27B 17/00*** | (2006.01) |
| ***G21F 9/30*** | (2006.01) |
| ***F27B 3/19*** | (2006.01) |
| ***F27D 99/00*** | (2010.01) |

(52) U.S. Cl.
CPC ..... *F27B 17/0016* (2013.01); *F27D 99/0006* (2013.01); *G21F 9/30* (2013.01); *F27B 2017/0091* (2013.01); *F27D 2099/0015* (2013.01); *F27D 2099/0031* (2013.01)

(56) References Cited

U.S. PATENT DOCUMENTS

| | | | | | |
|---|---|---|---|---|---|
| 4,655,437 | A * | 4/1987 | Fritz | C22B 4/005 | 266/197 |
| 4,699,653 | A * | 10/1987 | Barcza | C22B 4/005 | 75/10.19 |
| 5,280,757 | A * | 1/1994 | Carter | C01B 7/191 | 110/346 |
| 5,372,630 | A * | 12/1994 | Foo | C22B 7/02 | 75/10.3 |
| 5,579,705 | A * | 12/1996 | Suzuki | C03B 3/00 | 110/185 |
| 5,606,925 | A * | 3/1997 | Boen | B09B 3/005 | 110/250 |
| 5,673,285 | A | 9/1997 | Wittle et al. | | |
| 5,690,888 | A * | 11/1997 | Robert | C21B 7/14 | 222/590 |
| 7,216,593 | B2 | 5/2007 | Capote et al. | | |
| 8,110,019 | B2 * | 2/2012 | Fernandez Lopez | C22B 5/16 | 373/108 |
| 10,006,100 | B2 * | 6/2018 | Imris | C22B 5/16 | |
| 2004/0217526 | A1 | 11/2004 | Nakashima | | |
| 2010/0242675 | A1 * | 9/2010 | Fernandez Lopez | C22B 5/16 | 75/10.14 |
| 2014/0091503 | A1 * | 4/2014 | Ki | C22B 7/04 | 266/81 |
| 2015/0098484 | A1 | 4/2015 | Cho et al. | | |
| 2015/0232961 | A1 * | 8/2015 | Imris | C22B 5/16 | 501/1 |
| 2017/0081198 | A1 * | 3/2017 | Hoshino | C01B 32/984 | |
| 2018/0237306 | A1 * | 8/2018 | Shahverdi | C01B 33/025 | |

FOREIGN PATENT DOCUMENTS

| | | | |
|---|---|---|---|
| JP | 2001050530 | A | 2/2001 |
| JP | 2008 209040 | A | 9/2008 |
| JP | 2012132631 | A | 7/2012 |
| KR | 10 0334439 | B1 | 8/2002 |
| KR | 10 0415801 | B1 | 1/2004 |
| KR | 20 0343807 | | 2/2004 |
| KR | 10 1032055 | B1 | 5/2011 |
| KR | 10 2011 0113223 | A | 10/2011 |
| KR | 102012012875 | A | 11/2012 |
| KR | 10 1418105 | B1 | 7/2014 |
| WO | 1995014191 | A1 | 5/1995 |

* cited by examiner

PLASMA FURNACE HAVING LATERAL DISCHARGE GATES

TECHNICAL FIELD

The present invention relates to a plasma furnace having a lateral discharge gate capable of efficiently discharging molten material in a low viscosity state.

BACKGROUND ART

In the case of plasma furnaces using plasma, a method of discharging molten material is a method of discharging molten material by tilting a furnace or a method of discharging molten material after further heating the molten material using an induction heating device around an outlet of the furnace. The plasma furnace of Tsuruga nuclear power plant in Japan or Zwilag in Switzerland manufactured by Retech, USA, uses a method of discharging through an outlet positioned the bottom. In the case of JNFL in Japan, an outlet positioned at the center of the bottom of the cone type furnace is heated by an induction heating method and then molten material is discharged.

In the case of using the lateral outlet, a method of heating and discharging the molten material by using a heating torch as an additional heat source near the outlet is used. When the molten material at a high temperature over 1,600° C. is discharged to the outlet of the furnace, its viscosity rapidly becomes higher than 100 poise due to the decrease in the temperature of the molten material so that the outlet may become clogged by solidification at the outlet.

PRIOR ART LITERATURE

1. Registered Patent Publication No. 10-1032055 (Publication Date: May 2, 2011)
2. Registered Utility Model Publication No. 20-0343807 (Publication Date: May 17, 2004)

DISCLOSURE

Technical Problem

The present invention has been made to solve the above problems occurring in the prior art, and the purpose of the present invention is to provide a plasma furnace capable of effectively discharging molten material in a low viscosity state and separating and discharging different kinds of molten material according to their specific gravity.

Technical Solution

In order to achieve these objects, a drum type waste input apparatus for a plasma furnace according to the present invention comprises: a furnace body; and a heating portion, wherein the furnace body comprises a melt discharge portion formed through a lower portion of the melting chamber provided for accommodating molten material; and at least two lateral discharge gates provided at different heights capable of discharging molten material, and wherein the heating portion is capable of heating the lateral discharge gate.

Preferably, the melt discharge portion comprises a dam type discharge gate provided to protrude on the lower portion of the melting chamber to discharge the molten material above a predefined height.

More preferably, the dam type discharge gate further comprises an induction heater.

Preferably, the lateral discharge gate is moved up and down with respect to the furnace body to open and close a discharge flow path.

Preferably, the plasma furnace further comprises a discharge chamber provided on the lateral portion of the furnace body for accommodating the discharged melt along the lateral discharge gate and having an outlet at the lower portion. More preferably the discharge chamber may further comprise a window for observing the inside, and may further comprise a door that can be opened and closed.

Advantageous Effects

The plasma furnace of the present invention comprises a melt discharge portion formed through a lower portion of a melting chamber and at least two lateral discharge gates provided on the side of the melting chamber at different heights for discharging the molten material. Accordingly, the clogging phenomenon at the melt discharge portion in the lower portion of the melting chamber due to the molten material in a high viscosity state can be solved and also the different kinds of melts can be separated and discharged according to the specific gravity.

BEST MODE

The specific structure or functional description presented in the embodiments of the present invention is merely illustrative for the purpose of describing an embodiment according to the concept of the present invention, and embodiments according to the concept of the present invention may be embodied in various forms, and should not be construed as limited to the embodiments set forth herein, but should be understood to include all modifications, equivalents, and alternatives falling within the spirit and scope of the invention.

On the other hand, in the present invention, the terms such as a first and/or second etc. may be used to describe various components, but the components are not limited to the terms. The terms may be referred only for the purpose of distinguishing one component from another component. For example, the first component may also be referred to as a second component to the extent not departing from the scope of the invention in accordance with the concept of the present invention; likewise, the second component may also be referred to as a first component.

It is to be understood that when an element is referred to as being "connected" or "coupled" to another element, it may be directly connected or coupled to the other element, but it should be understood that other elements may be present in between. On the other hand, when it is mentioned that an element is directly connected or directly coupled to another element, it should be understood that there are no other elements in between. Other expressions for describing the relationship between components, such as "between" and "between" or "adjacent to" and "directly adjacent to" and the like should also be interpreted likewise.

The terminology used herein is for the purpose of describing particular embodiments only and is not intended to limit the invention. The singular forms include plural referents in meaning unless the context clearly dictates otherwise. It is to be understood that the terms "include", "have", "comprise" and the like in the specification are intended to specify the presence of stated features, integers, steps, operations, elements, parts, or combinations thereof, but they shall not preclude the presence or addition of one or more other features, integers, steps, operations, elements, parts, or combinations thereof.

Hereinafter, the present invention will be described in detail with reference to the accompanying drawings.

Figure 1:
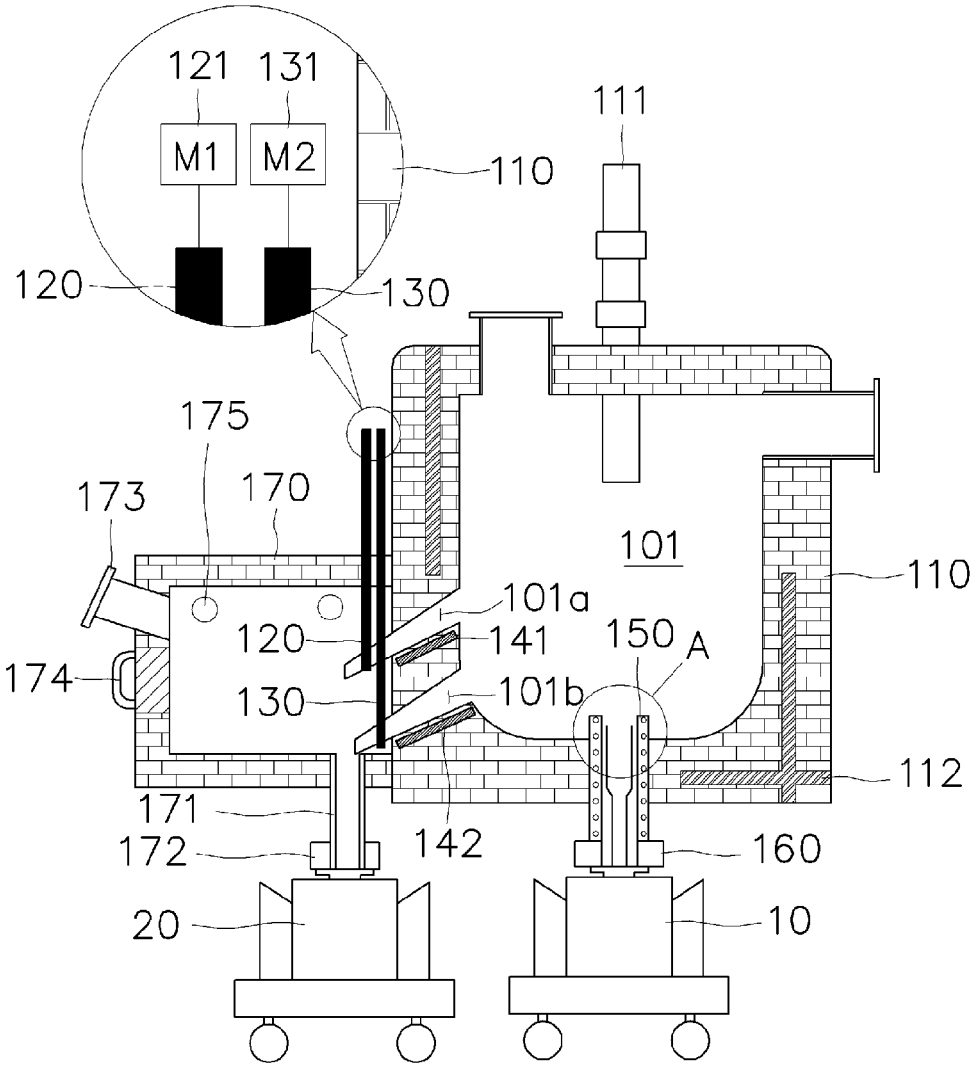
FIG. 1 is a configuration diagram of a plasma furnace according to the present invention.

As illustrated in FIG. 1, the plasma furnace of the present invention comprises a furnace body 110; and a heating portion 141, 142 capable heating a lateral discharge gate 120, 130, wherein the furnace body comprises a melting chamber 101 for accommodating molten material, and two lateral discharge gates 120, 130 capable of discharging molten material at different heights on the side of the melting chamber 101.

The furnace body 110 may be made using a material with a high thermal stability such as heat-resistant bricks, and a cooling channel 112 is formed in the inside of the furnace body 110. Accordingly, the outer surface of the furnace body 110 can be cooled and maintained at a proper temperature below 60° C. by circulation of cooling water.

The furnace body 110 provides melting heat for melting the introduced waste by an installed plasma torch 111. The plasma torch 111 is installed at the upper end of the melting chamber 101 of the furnace body 110 and a dual plasma torch capable of transferred or non-transferred operation may be provided. Electrodes (not shown) for transferred operation may be provided at the lower portion of the melting chamber, and the melting efficiency can be maximized by using the Joule's heat and torch frame temperature and arc heat.

A melt discharge portion is provided in the lower portion of the furnace body 110, and in particular, the melt discharge portion is provided by a dam-type discharge gate 150, and preferably further includes an induction heating type heater.

A first clamp 160 may be provided at the lower end of the dam-type discharge gate 150 so as to be detachably coupled to a first mold apparatus 10. The first clamp 160 may be connected to the first mold apparatus 10 with a hermetic seal, Accordingly, when the molten material is discharged into the first mold apparatus 10, the outside air cannot flow into the inside of the furnace, and the atmosphere inside the furnace can be maintained.

On the other hand, the first clamp 160 may be provided with a packing member such as a gasket or a synthetic rubber so that the first clamp 160 can be assembled with the first mold apparatus 10 in an airtight state. A cooling circuit may be provided to have the cooling water circulated to the first clamp 160 or its periphery so as to prevent degradation of the packing member due to a high temperature.

Figure 2:
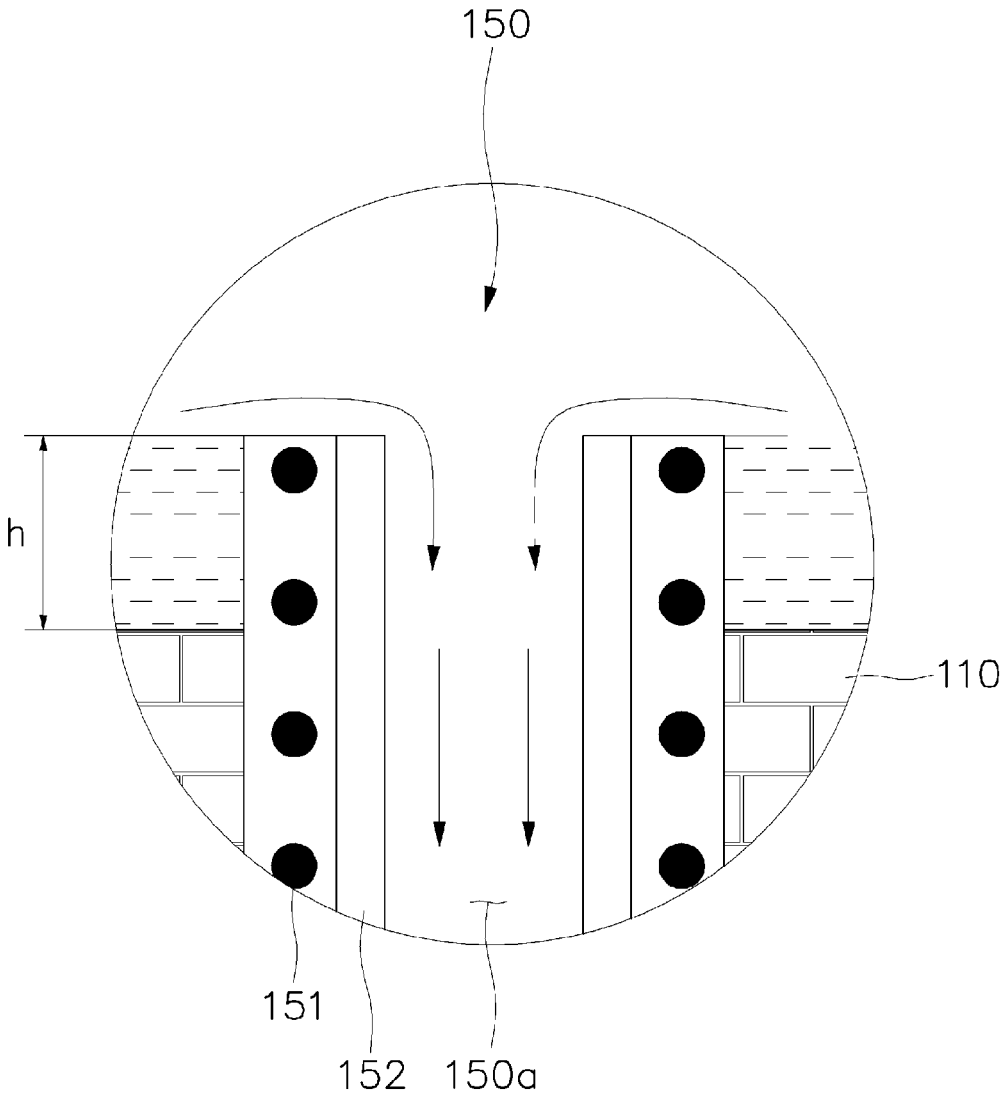
FIG. 2 is an enlarged view of part A in FIG. 1.

Specifically referring to FIG. 2, the dam-type discharge gate 150 is formed to protrude from the bottom surface of the furnace body 110 by a predetermined height, h or more and may include an induction coil 151 of a cylindrical shape provided to surround the lower outlet 150*a*, and an exhaust tube 152, that is, an electric conductor for indirect induction heating fixed inside the induction coil 151.

Accordingly, even if the molten material in the melting chamber 101 is completely discharged through the dam-type discharge gate 150, the molten material under a predetermined height (h) remains in the melting chamber 101 at all times. Before the waste is introduced, the inner wall of the melting chamber 101 is prevented from being directly exposed to a high temperature by the high-temperature plasma generated in the plasma torch 111 in the preheating process.

On the other hand, when the power is not applied to the induction coil 151 at the dam-type discharge gate 150, the molten material becomes a solid in a high viscosity state to close the lower outlet 150*a*. When the power is applied, the solid becomes thin to be discharged to the outside through the lower outlet 150*a* by its own weight.

The melt discharge portion provided at the lower portion of the furnace body 110 may be used for discharging a metal material having a large specific gravity among the molten material or for discharging the entire molten material.

Figure 3:
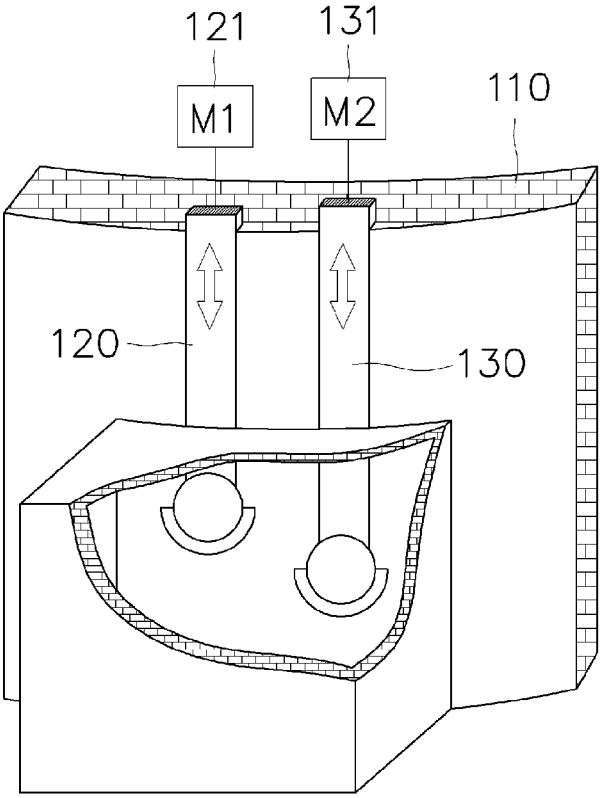
FIG. 3 is a configuration diagram showing an enlarged view of a lateral discharge gate of the plasma furnace according to the present invention.

Referring to FIG. 1 and FIG. 3, in the plasma furnace according to the present invention, the furnace body 110 is provided with two lateral discharge gates 120, 130 for discharging the molten material at different heights on the side of the melting chamber 101, and the heating portion 141, 142 capable of heating the lateral discharge gates 120, 130 is further included.

Each lateral discharge gate 120, 130 is provided with a motor-operated or hydraulic drive unit 121, 131 to open and close each discharge flow path 101*a*, 101*b* by a vertical movement in the furnace body 110.

Each discharge flow path 101*a*, 101*b* is formed with a predetermined slope through the furnace body 110 so that the molten material can be easily discharged to the outside by its own weight. A heating portion 141, 142 is provided adjacent to the discharge flow path 101*a*, 101*b* to maintain the discharged molten material at a melting temperature (1600° C.) or higher.

The heating portion 141, 142 may be provided as a metal or non-metal heater and may be formed as a wire or a plane depending on the size and length of the discharge flow path 101*a*, 101*b*. On the other hand, it can be provided by an induction heating-type heat source as another embodiment of the heating portion.

In this embodiment, it is exemplified that a heating element is provided in each discharge flow path 101*a*, 101*b*. However, the two discharge flow paths 101*a*, 101*b* may be heated by one common heating element.

Preferably, a discharge chamber 170 provided at the side of the furnace body 110 may be further comprised to accommodate the molten material discharged from each lateral discharge gate 120, 130.

The discharge chamber 170 may be an enclosed structure integrated with the furnace body 110 or may be a detachable structure with the furnace body 110. Meanwhile, when the discharge chamber 170 is provided as a detachable structure with the furnace body 110, a hermetic member may be added between the discharge chamber 170 and the furnace body 110 to maintain a hermetic seal.

The discharge chamber 170 is provided with a slag outlet 171 at a lower portion thereof and a second clamp 172 at a lower end of the slag outlet 171 to which the second mold apparatus 20 is detachably coupled. The second clamp 172 is connected to the second mold apparatus with a hermetic seal. Accordingly, when the molten material, slag is discharged into the second mold apparatus 20, outside air cannot flow into the discharge chamber and the atmosphere inside the furnace can be maintained.

The second clamp 172 may be provided with a packing member such as a gasket or a synthetic rubber so that the second clamp 172 can be assembled with the second mold apparatus 20 in an airtight state. A cooling circuit may be provided to have the cooling water circulated to the second clamp 172 or the periphery thereof so as to prevent degradation of the packing member due to a high temperature.

The discharge chamber 170 may be provided with an observation window 173 for observing the discharge gate 120, 130 and may be provided with a surveillance camera (not shown) capable of capturing an image signal.

The discharge chamber 170 may be provided with a door 174 that can be opened and closed at the front thereof so as to be able to collect a sample when the molten material is discharged. In the discharge chamber 170, a heating means 175 may be provided so as to control the temperature inside the discharge chamber 170. Such a heating means 175 may be provided by molybdenum disilicide, $MoSi_2$, which is effective as a heating element even at a high temperature of 1,500° C. or higher.

In this embodiment, the lateral discharge gate 120, 130 is provided outside the furnace body 110 to be opened and closed. However, the lateral discharge gate may be provided inside the furnace body or in the melting chamber to discharge the molten material.

Figure 4A:
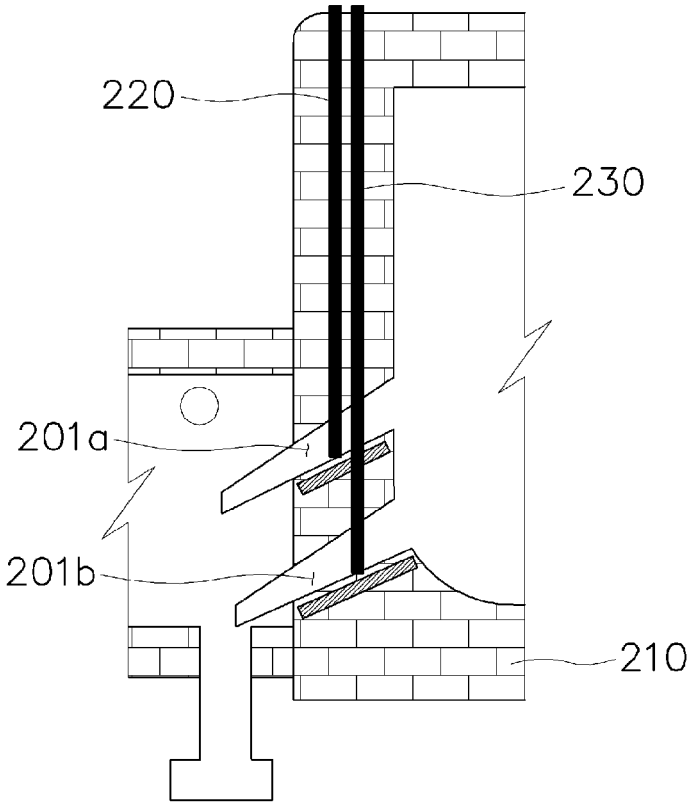
FIGS. 4A and 4B show a lateral discharge gate of the plasma furnace according to other embodiments of the present invention.
Figure 4B:
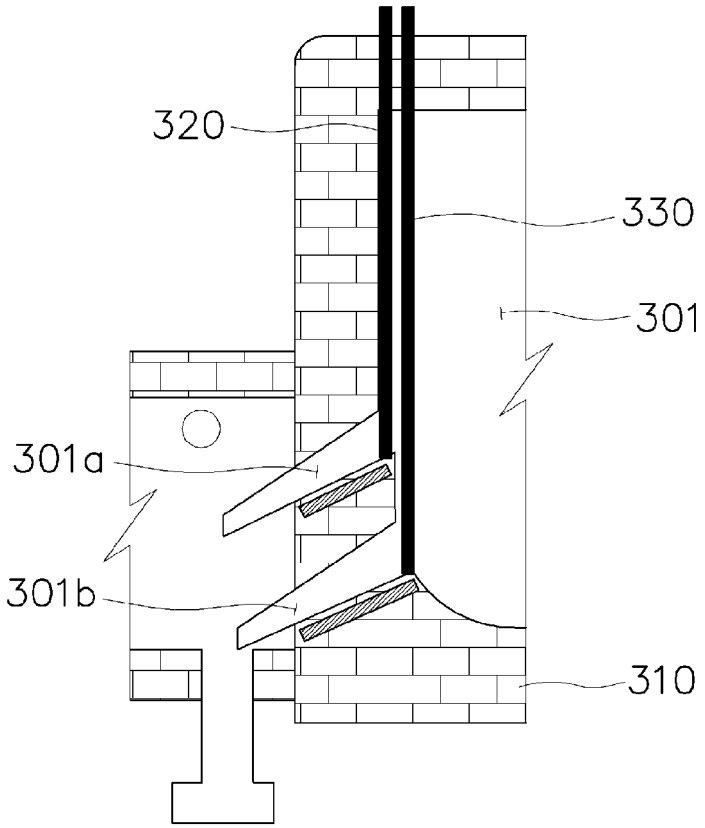

FIGS. 4A and 4B show a lateral discharge gate of the plasma furnace according to other embodiments.

As illustrated in FIG. 4A, two lateral discharge gates 220, 230 are inserted through the lateral wall of the furnace body 210 so as to move up and down to open and close the discharge flow path 201*a*, 201*b*.

As illustrated in FIG. 4C, two lateral discharge gates 320, 330 can be provided on the inner lateral wall of the furnace body 310 to control the discharge of molten material from the melting chamber 301 into the discharge flow path 301*a*, 301*b*.

As mentioned above, the lateral discharge gate can have a variety of layouts, and preferably is located outside the furnace body.

Referring to FIG. 1, two lateral discharge gates 120, 130 are provided outside the furnace body, by which maintenance of the lateral discharge gate 120, 130 can be performed more easily than the case where lateral discharge gates are inserted through the lateral wall of the furnace body. In addition, and the possibility of design interference with the cooling channel 112 provided in the furnace body 110 can be eliminated.

It will be apparent to those skilled in the art that the present invention is not limited to the aforementioned embodiments and accompanying drawings, and various modifications and variations can be made in the present invention without departing from the spirit or scope of the general inventive concept as defined by the appended claims.

DESCRIPTION OF THE REFERENCE NUMERALS IN THE DRAWINGS

101*a*, 101*b*: discharge flow path 110: furnace body
111: plasma torch 112: cooling channel
120, 130: lateral discharge gate 141, 142: heating portion
150: dam-type discharge gate 160: first clamp
170: discharge chamber 171: slag outlet
172: second clamp 173: observation window
174: door 175: heating means

The invention claimed is:

1. A plasma furnace for producing and discharging a molten material, the plasma furnace comprising:
- a furnace body, comprising:
  - a melting chamber for accommodating the molten material in a lower portion thereof;
  - a melt discharge portion formed through the lower portion;
  - at least two lateral discharge gates provided at different heights in the lower portion, for discharging the molten material; and
  - a dam type discharge gate provided to protrude on the lower portion of the melting chamber to retain in the melting chamber a predetermined amount of the molten material; and
- a heating portion, for heating the at least two lateral discharge gates.

2. The plasma furnace according to claim 1,
wherein the dam type discharge gate further comprises an induction heater.

3. The plasma furnace according to claim 1,
wherein each of the lateral discharge gates is moved up and down with respect to the furnace body to open and close a discharge flow path.

4. The plasma furnace according to claim 1, further comprising:
- a discharge chamber provided on a lateral portion of the furnace body for accommodating the discharged molten material along each of the lateral discharge gates and having an outlet at a lower portion thereof.

5. The plasma furnace according to claim 4,
wherein the discharge chamber further comprises a window for observing the inside of the furnace.

6. The plasma furnace according to claim 4 or claim 5,
wherein the discharge chamber further comprises a door that can be opened and closed.

* * * * *